US005344283A

United States Patent [19]

Magowan et al.

[11] Patent Number: 5,344,283

[45] Date of Patent: Sep. 6, 1994

[54] TURBINE VANE HAVING DEDICATED INNER PLATFORM COOLING

[75] Inventors: John W. Magowan, Longmeadow, Mass.; Richard J. Pawlaczyk, Newington, Conn.; Annette M. Pighetti, Andover, Conn.; Richard A. Schwarz, Jr., Somers, Conn.

[73] Assignee: United Technologies Corporation, Hartford, Conn.

[21] Appl. No.: 8,959

[22] Filed: Jan. 21, 1993

[51] Int. Cl.[5] ..... F01D 5/14

[52] U.S. Cl. ..... 415/115; 416/193 A

[58] Field of Search ..... 415/115, 116; 416/193 A

[56] References Cited

U.S. PATENT DOCUMENTS

| | | | |
|---|---|---|---|
| 2,737,366 | 3/1956 | Ledinegg | 253/39.15 |
| 3,066,910 | 12/1962 | Bluck | 253/39.15 |
| 3,446,481 | 5/1969 | Kydd | 253/39.15 |
| 3,446,482 | 5/1969 | Kydd | 253/39.15 |
| 4,017,213 | 4/1977 | Przirembel | 416/97 |
| 4,040,767 | 8/1977 | Dierberger et al. | 415/115 |
| 4,137,619 | 2/1979 | Beltran et al. | 29/156.8 |
| 4,672,727 | 6/1987 | Field | 29/156.8 |
| 4,676,719 | 6/1987 | Auxier et al. | 416/97 R |
| 4,920,742 | 5/1990 | Nash et al. | 415/116 |
| 4,946,346 | 8/1990 | Ito | 415/115 |
| 5,096,379 | 3/1992 | Stroud et al. | 416/97 R |
| 5,122,033 | 6/1992 | Paul | 416/96 R |
| 5,135,354 | 8/1992 | Novotny | 416/193 A |
| 5,142,859 | 9/1992 | Glezer et al. | 415/115 |
| 5,193,982 | 3/1993 | Inizan et al. | 416/193 A |

FOREIGN PATENT DOCUMENTS

| | | |
|---|---|---|
| 742288 | 2/1952 | United Kingdom . |
| 2070147 | 2/1981 | United Kingdom . |

*Primary Examiner*—John T. Kwon

[57] ABSTRACT

A turbine vane for a gas turbine engine core adaptable to be operated in a variety of thrust regimes is disclosed. Various construction details are developed which provide cooling to an inner platform of the turbine vane. In one particular embodiment, a turbine vane includes a hollow core permitting cooling fluid to pass through the vane and an inner platform having a pocket disposed therein, the pocket being in fluid communication with the core. Heat is exchanged between the platform and the cooling fluid within the pocket. Cooling holes extend between the pocket and a flow surface of a platform to provide cooling of the flow surface.

7 Claims, 3 Drawing Sheets

TURBINE VANE HAVING DEDICATED INNER PLATFORM COOLING

DESCRIPTION

1. Technical Field

This invention relates to gas turbine engines, and more particularly to a turbine vane having an integral inner platform.

2. Background of the Invention

A typical gas turbine engine has an annular, axially extending flow path for conducting working fluid sequentially through a compressor section, a combustion section, and a turbine section. The compressor section includes a plurality of rotating blades which add energy to the working fluid. The working fluid exits the compressor section and enters the combustion section. In the combustion section, fuel is mixed with the compressed working fluid and the mixture is ignited to thereby add more energy to the working fluid. The resulting products of combustion are then expanded through the turbine section. The turbine section includes a plurality of rotating blades that engage the expanding fluid to extract energy from the expanding fluid. A portion of this extracted energy is transferred back to the compressor section via a rotor shaft interconnecting the compressor section and turbine section. The remainder of the energy may be used for other functions.

The work produced by the gas turbine engine is proportional to the temperature increase resulting from the combustion process. Material limitations of structure within the turbine section, however, limit the temperature of working fluid exiting the combustion section and entering the turbine section. As a consequence, the work produced by the gas turbine engine is limited by the allowable temperature of the working fluid within the turbine section.

One method of increasing the allowable temperature of working fluid within the turbine section is to cool the affected structure. Typically this is accomplished by bypassing the combustion process with a portion of the working fluid from the compressor section. This cooling fluid is flowed around the combustion section, through or over structure within the turbine section, and into the flow path. Heat from the turbine section structure is transferred to the cooling fluid and this heat is then carried away as the cooling fluid mixes with the working fluid within the flow path. Bypassing the combustion section and a portion of the turbine section with a portion of working fluid from the compressor section, however, lowers the operating efficiency of the gas turbine engine. Therefore, the amount of bypass fluid is minimized to achieve optimum operating efficiency of the gas turbine engine.

The turbine section is comprised of a plurality of turbine rotor blades and turbine vanes which extend through the flow path and thus are engaged directly with hot working fluid. The rotor blades engage working fluid to extract energy from the expanding gases. The turbine vanes orient the flow of working fluid to optimize the engagement of working fluid with the rotor blades for efficient energy transfer. Each vane includes an airfoil portion extending radially across the flow path, an outer platform disposed radially outward of the airfoil section and an inner platform disposed radially inward of the airfoil portion. The platforms provide radially outward and inward flow surfaces for working fluid within the flow path to confine the flow of working fluid to the airfoil portion of the vane.

Direct contact between the vanes and hot working fluid heats the vanes and increases the temperature of the vane structure. To counter this, the vane is typically hollow and cooling fluid is flowed into the hollow vane. This cooling fluid cools the airfoil portion of the vane. In a first stage turbine vane, cooling fluid is typically flowed into both the radially inner and outer ends of the vane. This cooling fluid cools the platforms, the airfoil portion, exits through cooling holes in the vane and flows in to the working fluid flow path. In a second stage turbine vane, however, cooling fluid is only available at the radially outer end of the vane. This cooling fluid cools the outer platform and airfoil portion. Part of this cooling fluid exits the vane through cooling holes in the vane and the remainder flows radially inward of the turbine vane to cool the inner platform and other structure radially inward of the second stage turbine vane. While adequate for prior gas turbine engines, such a cooling mechanism is not sufficient for modern high output, high temperature engines.

Another concern for cooling schemes is to minimize the amount of cooling fluid required. Directing cooling fluid away from the combustion section reduces the operating efficiency of the engine. This is especially significant for later turbine stages since the fluid also bypasses a portion of the turbine section. Therefore there is no energy exchange between such fluid and the bypassed stages of the turbine section. Effective use of such cooling fluid is necessitated by the need to minimize such fluid.

For a given gas turbine engine core to be used in different thrust regimes requires the cooling system to provide adequate cooling in significantly different temperature environments. One method of accomplishing this is to provide additional quantities of cooling fluid to counter the higher temperature working fluid encountered at higher thrust applications. The drawback to this method is the reduction in operating efficiency of the gas turbine engine as a result of redirecting a greater portion of the working fluid to bypass the combustion section.

The above art notwithstanding, scientists and engineers under the direction of Applicants' Assignee are working to develop turbine vanes applicable to an gas turbine engine core which is adaptable to a variety of thrust regimes.

DISCLOSURE OF THE INVENTION

According to the present invention, a turbine vane includes an integral inner platform cooled by flowing cooling fluid through a pocket defined in part by the inner platform.

According further to the present invention, the turbine vane includes a hollow airfoil portion and a cover radially inward of the inner platform with the pocket defined therebetween, wherein cooling fluid is exchanged between the pocket and the hollow airfoil portion via a fluid passage.

According further still, the inner platform includes cooling holes extending between the pocket and the working fluid flow path, the cooling holes defining means to flow cooling fluid over the flow surface of the inner platform.

According to a specific embodiment, the turbine vane includes a first pocket extending upstream of the airfoil portion, a second pocket extending laterally along the pressure surface of the airfoil portion, and a third pocket extending downstream of the airfoil portion, and wherein the vane includes cooling holes providing fluid communication between the pockets and the flow surface of the inner platform.

A principal feature of the present invention is the pocket defined by the integral inner platform and the cover. Another feature is the cooling holes disposed between the pocket and the inner platform flow surface. A further feature is the fluid passage disposed between the cavity of the hollow airfoil portion and the pocket. A still further feature is the positioning of the plurality of pockets about the inner platform.

A primary advantage of the present invention is the operating efficiency of the gas turbine engine as a result of optimizing the use cooling fluid being flowed to the turbine vane. The pockets permit cooling of the inner platforms using available cooling fluid within the airfoil portion. Making further use of this cooling fluid minimizes the need to use additional bypass fluid from the compressor section. Another advantage of the present invention is the applicability of the turbine vane to a gas turbine engine core adapted to be used in different thrust regimes as a result of the optional fluid passage. The fluid passage may be left closed for lower thrust applications to minimize the cooling fluid required. In higher thrust applications, the fluid passage may be opened to permit fluid communication between the cavity and the pockets to provide additional cooling to the inner platform. Another advantage is the effectiveness of the cooling as a result of convective cooling within the pocket and film cooling over the platform flow surface. An advantage of the particular embodiment is the optimal location of the pockets. Each of the pockets is located in a region of particularly high temperature, the leading edge, the pressure surface, and downstream of the trailing edge. Cooling holes are used to communicate a portion of the cooling fluid within the pocket over the flow surface of the inner platform.

The foregoing and other objects, features and advantages of the present invention become more apparent in light of the following detailed description of the exemplary embodiments thereof, as illustrated in the accompanying drawings.

BEST MODE FOR CARRYING OUT THE INVENTION

Figure 1:
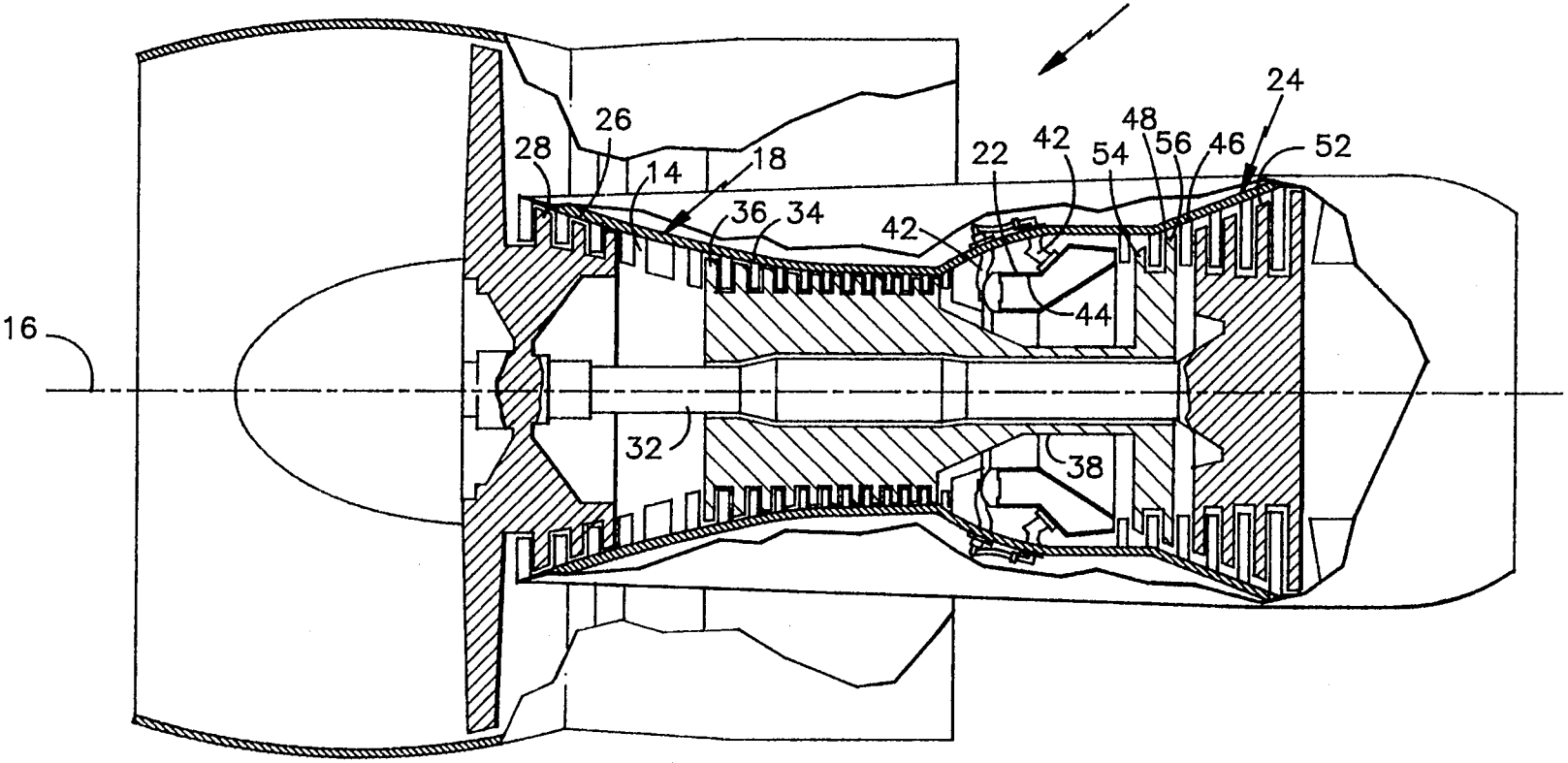
FIG. 1 is a side view, partially cut away, showing a gas turbine engine.

Referring to FIG. 1, a gas turbine engine 12 has an annular axially extending flowpath 14 disposed about a longitudinal axis 16 and includes a compressor section 18, a combustion section 22, and a turbine section 24. The compressor section includes a low pressure compressor 26 having a plurality of rotor blade assemblies 28 disposed on a low pressure shaft 32 and a high pressure compressor 34 having a plurality of rotor blade assemblies 36 disposed on a high pressure shaft 38. The combustion section includes a plurality of fuel nozzles 42 circumferentially disposed about the longitudinal axis and engaged with the upstream end of a combustion chamber 44. The turbine section includes a stator structure 46, a high pressure turbine 48 immediately downstream of the combustion chamber and a low pressure turbine 52 immediately downstream of the high pressure turbine. The high pressure turbine includes a pair of rotor blade assemblies 54 engaged with the high pressure shaft and having a plurality of airfoil shaped blades 56 extending through the flowpath.

Figure 2:
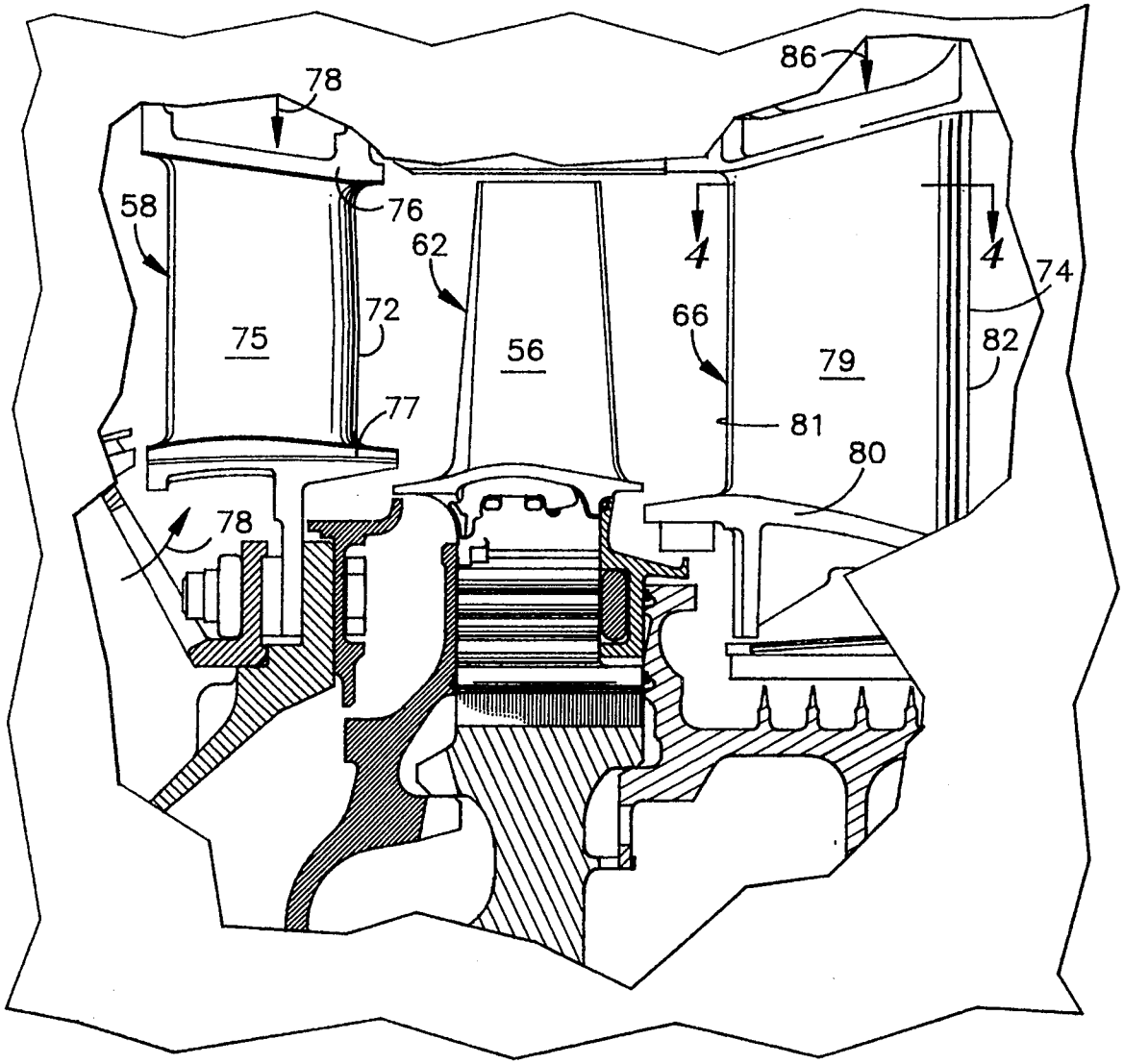
FIG. 2 is a side view of a turbine section, partially sectioned to show a first vane assembly, a first rotor blade assembly, and a second vane assembly.

Referring now to FIG. 2, the high pressure turbine includes a first vane assembly 58 axially disposed between the combustion chamber and a first rotor blade assembly 62, and second vane assembly 66 axially disposed between the first rotor blade assembly and a second rotor blade assembly (not shown). Each of the vane assemblies are comprised of a plurality of airfoil shaped vanes 72,74 extending across the flowpath and attached at the radially outer ends to the stator structure. The vanes engage the working fluid in the flowpath to orient the flowing working fluid for optimal engagement with the rotating blades of the rotor assemblies.

Each of the first vanes 72 includes an airfoil portion 75, an outer platform portion 76, and an inner platform portion 77. The airfoil portion extends through the flowpath and includes internal passages to permit cooling fluid to flow through the first vane. As a result of the forward location of the first vane, cooling fluid flows both radially inward and outward through the first vane, as shown by arrows 78. The outer platform is cooled by impingement of the radially inward flowing cooling fluid and the inner platform is cooled by impingement of the radially outward flowing cooling fluid.

Each of the second vanes 74 includes an airfoil portion 79 and an inner platform portion 80. The airfoil portion extends radially between the stator structure and the inner platform and includes a leading edge 81 and trailing edge 82. The airfoil portion has a hollow core 84 (see FIG. 3) to permit cooling fluid to flow internally within the airfoil portion. The cooling fluid is drawn from the compressor section and flows radially inward into the hollow core, as shown by arrow 86, from cooling passages within the stator structure. No radially outwardly directed cooling flow is available due to the location of the second vane downstream of the first rotor assembly. The inner platform is disposed at the radially inner end of the vane and provides a flow surface 80 for the working fluid within the flowpath. The flow surface confines the flow of working fluid to the airfoil portion of the vane for optimum engagement of the working fluid with the airfoil portion.

Figure 3:
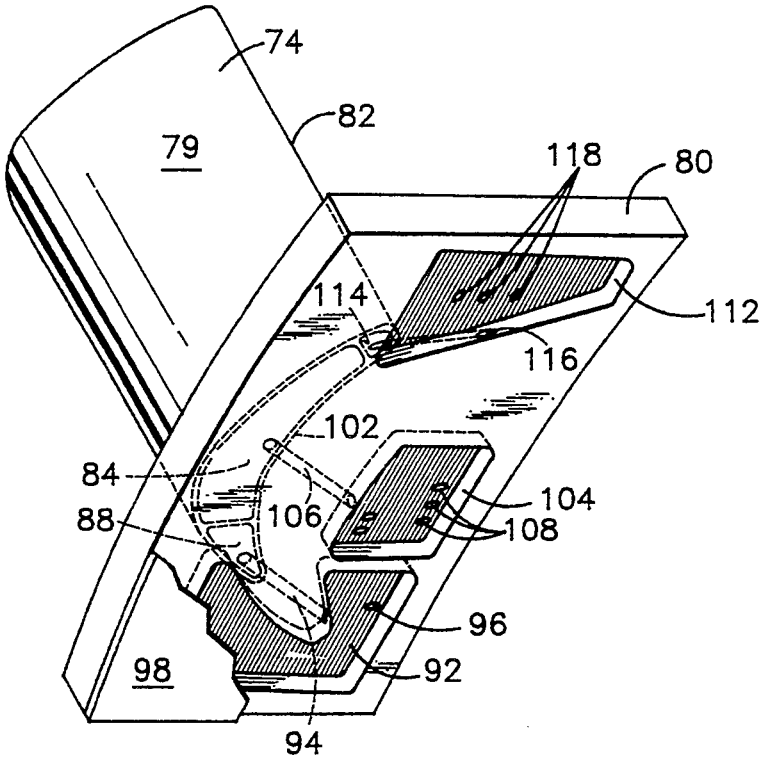
FIG. 3 is a perspective view of a turbine vane, partially cut-away to show a plurality of inner platform cooling pockets in fluid communication with a hollow vane airfoil section.
Figure 4:
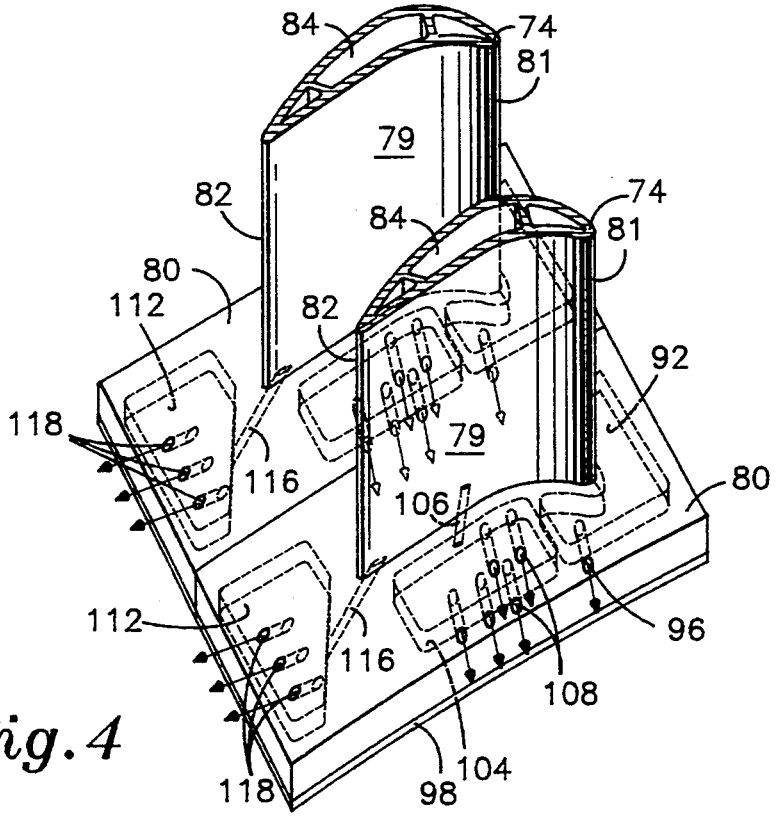
FIG. 4 is a perspective view of adjacent turbine vanes showing the location of a plurality of cooling holes with arrow indicating the direction of cooling fluid flow.

As shown more clearly in FIGS. 3 and 4, the inner platform includes a first core extension 88 extending radially inward from the airfoil core and a first pocket 92 disposed axially forward of the leading edge of the vane and interconnected with the first core extension by a first cooling passage 94. The first pocket is in fluid communication with the flowpath by a cooling hole 96 disposed between the first pocket and the flow surface of the inner platform. A cover plate 98 is disposed radially inward of the inner platform. The separation between the inner platform and the cover defines the first pocket. The inner platform defines the radially outer and lateral surfaces of the first pocket. The cover defines the radially inner surface of the first pocket.

A second core extension 102 extends radially inward from the airfoil core and is connected to a second pocket 104 by a second cooling passage 106 extending therebetween. The second pocket is disposed laterally adjacent to the pressure surface of the airfoil portion and includes a plurality of cooling holes 108 extending between the second pocket and the flow surface. The cooling holes provide fluid communication between the second pocket and the flow surface of the inner platform adjacent to the pressure surface. The second pocket is also defined by the radial separation between the inner platform portion and the cover.

A third pocket 112 is disposed downstream of the trailing edge of the airfoil portion and is connected to a third core extension 114 by a third cooling passage 116. A plurality of cooling holes 118 extend between the third pocket and the flow surface of the inner platform. These cooling holes provide fluid communication between the third pocket and the flow surface of the inner platform downstream of the trailing edge. As with the first and second pockets, the third pocket is defined by the radial separation between the inner platform and the cover.

During operation, cooling fluid is flowed through the stator structure and radially inward into the hollow core of the airfoil portion 79 of the second vane 74. This cooling fluid cools the airfoil portion by removing heat transferred to the airfoil portion by direct contact with the hot working fluid. A portion of the cooling fluid flows through the core extensions 88, 102, 114 through the cooling passages 44, 106, 116, and into the pockets 92, 104, 112 of the inner platform 80. This cooling fluid then cools the inner platform in the region of the pockets. The cooling fluid exits the pockets through the cooling holes 96, 108, 118. The cooling fluid conducts heat from the platform as it flows through the passages and provides film cooling over the flow surfaces of the inner platform. As shown in FIG. 4, the cooling holes are angled such that the cooling fluid is ejected from the pockets and out over the inner platform flow surfaces between adjacent vanes. In this way, the cooling fluid cools the flow surface along the pressure face of the airfoil portion of the immediate vane and the flow surface along the suction side of the adjacent vane. In addition, the cooling holes of the third pocket eject cooling fluid over the downstream end of the inner platform. The cooling holes of the third pocket provide film cooling of this remote section of the inner platform. The working fluid then carries the cooling fluid into the flowpath and downstream of the vane assembly.

As shown in FIGS. 3 and 4, each vane includes a cooling passage connecting the core extensions with each of the inner platform pockets and includes cooling holes extending between the pockets and the flow surface of the inner platforms. This configuration provides maximum cooling to the inner platform of the vane. For operating conditions of the gas turbine engine which result in the most stringent environmental conditions relative to temperature, i.e. high thrust output applications, this maximum cooling configuration may be required. In other applications, however, other configurations may be adequate. For instance, for a vane subject to less stringent temperature requirements, some or all of the film cooling holes may not be required.

In still further applications, it may not be necessary to flow cooling fluid to any or all of the pockets. In this application, the cooling passages between the core extensions and the pockets will remain closed such that a barrier exists between each core extension and each pocket. The barrier prevents cooling fluid being exchanged between the airfoil core and the pockets. This configuration may be sufficient for low temperature environments resulting from the use of the vane assembly in reduced thrust output applications. By blocking cooling fluid flow to the pockets in this way, the amount of cooling fluid required is minimized to optimize the efficiency of the gas turbine engine.

As shown in FIGS. 1–4, the vane provides a flexible scheme for providing adequate cooling in a variety of temperature environments. In this way the same vane may be used with a gas turbine engine core adapted for low thrust output and with the same gas turbine engine core adapted for a high thrust output application. In converting the gas turbine engine core, typically the temperature environment of the turbine section is increased in relation to the increase in thrust output. The base vane configuration (without cooling passages between the core and pockets) may be adapted to provide additional cooling by drilling the barrier to define the cooling passages between the core extensions and the pockets. This will provide for exchange of cooling fluid between the airfoil core and the cooling pockets to thereby cool the inner platform to provide additional cooling of the inner platform. Further, cooling holes may also be drilled between the inner platform surface and the pockets to provide film cooling of the inner platform surface. The quantity, location, and orientation of the cooling holes is dependent upon the location of the regions of the inner platform flow surface requiring the additional cooling provided by the film cooling.

The invention as illustrated in FIGS. 1–4 includes three cooling passages, with each cooling passage connecting one of the pockets with the airfoil core. It should be apparent to those skilled in the art that the pockets may be made to be in fluid communication and therefore only one cooling passage would be necessary to connect all the interconnected pockets to the airfoil core.

Although the invention has been shown and described with respect with exemplary embodiments thereof, it should be understood by those skilled in the art that various changes, omissions, and additions may be made thereto, without departing from the spirit and scope of the invention.

What is claimed is:

1. A turbine vane for a gas turbine engine disposed about a longitudinal axis and having an axially oriented annular flow path therethrough, the gas turbine engine including a compressor section, a combustor section, a turbine section downstream of the combustor section, and a source of cooling fluid, the turbine section including the turbine vane, wherein the turbine vane includes:

an airfoil portion extending through the flow path, the airfoil portion including a hollow core therein, the core being open at its radially outer end to define a passage for conducting cooling fluid from the source through the airfoil portion;

a platform portion disposed radially inwardly of the airfoil portion and oppositely of the open end of the core, the platform having a radially outer surface defining a flow surface for working fluid within the flow path, the platform including a plurality of pockets and a plurality of cooling holes, each of the pockets having a cooling passage permitting fluid communication with the core such that cooling fluid is exchanged between the core and the pocket to thereby transfer heat from the platform to the fluid within the pocket, and the cooling holes extending between each of the pockets and the flow surface and defining means to eject cooling fluid over the flow surface of the platform.

2. The turbine vane according to claim 1, wherein the airfoil portion includes a leading edge and one of the plurality of pockets extends into the region of the platform which is axially upstream of the leading edge of the airfoil portion.

3. The turbine vane according to claim 1, wherein the airfoil portion includes a pressure surface and one of the plurality of pockets extends into the region of the platform which is adjacent to the pressure surface of the airfoil portion.

4. The turbine vane according to claim 1, wherein the airfoil portion includes a trailing edge and one of the plurality of pockets extends into the region of the platform which is axially downstream of the trailing edge of the airfoil portion.

5. The turbine vane according to claim 2, further including a pressure surface disposed on the airfoil portion and wherein one of the plurality of pockets extends into the region of the platform which is adjacent to the pressure surface of the airfoil portion.

6. The turbine vane according to claim 2, further including a trailing edge disposed on the airfoil portion and wherein one of the plurality of pockets extends into the region of the platform which is axially downstream of the trailing edge of the airfoil portion.

7. The turbine vane according to claim 5, further including a trailing edge disposed on the airfoil portion and wherein one of the plurality of pockets extends into the region of the platform which is axially downstream of the trailing edge of the airfoil portion.

* * * * *